United States Patent [19]

Han

[11] Patent Number: 4,710,058

[45] Date of Patent: Dec. 1, 1987

[54] CONCRETE LINING MACHINE

[76] Inventor: Man Y. Han, Y-4-A Hensel Apt., College Station, Tex. 77840

[21] Appl. No.: 18,478

[22] Filed: Feb. 25, 1987

[51] Int. Cl.[4] ..... E21D 11/10

[52] U.S. Cl. ..... 405/146; 405/150

[58] Field of Search ..... 405/141, 145, 146, 150, 405/298; 299/33; 425/59

[56] References Cited

U.S. PATENT DOCUMENTS

| | | | |
|---|---|---|---|
| 4,173,421 | 11/1979 | Harboff et al. . | |
| 4,205,948 | 1/1980 | Hanson | 425/59 |
| 4,222,681 | 9/1980 | Khodosh et al. | 405/141 |
| 4,265,565 | 5/1981 | Stuckmann et al. | 405/145 |
| 4,270,876 | 6/1981 | Eklund et al. | 405/133 |
| 4,315,701 | 2/1982 | Ivenor et al. . | |
| 4,332,508 | 6/1982 | Krabbe | 405/144 |
| 4,334,800 | 6/1982 | Stuckmann | 405/145 |
| 4,363,202 | 12/1982 | Kenyon . | |
| 4,437,788 | 3/1984 | Walbrohl | 405/146 |
| 4,451,176 | 5/1984 | Floche et al. | 405/138 |
| 4,482,270 | 11/1984 | Unger et al. | 405/145 |

FOREIGN PATENT DOCUMENTS

| | | | |
|---|---|---|---|
| 2043743 | 10/1980 | United Kingdom | 405/298 |

OTHER PUBLICATIONS

"Advanced Techniques for Rapidly Placing Concrete Linings in Tunnels and Shafts" by Dr. Kenneth R. Maser (pp. 329 to 341, Construction Equipment and Techniques), 1982.

"Tunnel Construction State of the Art and Research Needs", chapters entitled Structural Supports and Machine Tunneling, Special Report 171, Transportation Research Board, Commission on Sociotechnical Systems, National Research Council, 1977.

"Tunnel-Boring Machines", J. George Thon, Tunnel Engineering Handbook, 1982, pp. 235-278.

*Primary Examiner*—David H. Corbin

*Attorney, Agent, or Firm*—Norvell & Associates

[57] ABSTRACT

An improved concrete lining machine is provided for lining the walls of a bored tunnel. The machine typically consists of three separable machine sections each having a frame and a plurality of supporting plates rotatable in an endless loop chain. Fresh concrete is sealed from the second machine section by a plurality of adjoining main and auxiliary plates which remain in place relative to the concrete until the concrete is at least substantially cured. According to the method of the present invention, the first machine portion partially supports the bored tunnel walls, and a third machine portion partially supports the curing concrete. The cost of tunnel lining according to the techniques of the present invention has been substantially reduced, and the machine may be placed directly behind a tunnel boring machine.

31 Claims, 20 Drawing Figures

CONCRETE LINING MACHINE

FIELD OF THE INVENTION

The present invention relates to techniques for forming linings in tunnels and shafts and, more particularly, relates to improved methods and apparatus for forming a concrete lining preferably positioned behind a conventional tunnel boring machine.

BACKGROUND OF THE INVENTION

The increased number of tunnels constructed in the past several decades has substantially enhanced tunneling technology and equipment. Tunneling equipment has progressed to the extent that approximately 200 feet per day can be frequently tunneled through relatively soft rock using a tunnel boring machine. Tunnels for vehicular and pedestrian traffic are becoming more popular, and recently constructed tunnels bore through increasingly longer lengths of earth. Tunneling techniques are also finding increased acceptance for various product or service transmission lines or cables. Proposed subterranean tunnels for atomic accelerators far exceed the practical technology available for their construction.

In most cases, a shaft or tunnel is not complete until a lining has been placed along the perimeter of the bored hole. Although liner placement frequently is a significant portion of the total cost of a tunneling project, improvements relating to tunnel boring machines have exceeded the capability of tunnel lining technology. Fixed cylinder "slip" or "jump" form linings have been used for decades for tunnel lining, and precast liners are widely used. Both of these techniques, however, are slow and labor intensive. Moreover, slip or jump form lining techniques pose considerable engineering problems, including limited advance speed, rapid wear, large propulsion equipment, and induced cracks in the extruded concrete linings. These significant engineering problems, in turn, are all directly or indirectly due to large frictional forces between the machine and the concrete tunnel walls.

A remote shotcrete shaft lining system has been developed for lining substantially vertical bore shafts. Modular segment assemblies supported by a wire rope are lowered into a borehole during shotcrete application, and the shotcrete lining is applied in a helical pattern. A slip form for applying a vertical shaft lining is also disclosed in U.S. Pat. No. 4,205,949. These techniques are, however, practically limited to lining vertical shafts, and are inherently expensive.

An extruded tunnel lining system has also been developed under sponsorship from the Department of Transportation and the Urban Mass Transit Administration. This system delivers concrete to the annulus behind a slip from, and the form advances at a steady rate with the exposed concrete behind the slip form being self-supporting. Although various techniques have been devised to try to reduce the force required to move the slip form, this technique suffers substantially from the inherent drag associated with trying to slide a lining along loosely formed or forming concrete.

Another slip form system referred to as a continuous lining system has been developed under sponsorship from the Department of Transportation. This system lines shafts from the top down, and otherwise operates in a manner similar to the extruded tunnel lining system. U.S. Pat. No. 4,270,876 also discloses techniques for lining a vertical mine shaft with concrete. Additional information regarding advancement in tunnel lining techniques are described in the article entitled "Advanced Techniques for Rapidly Placing Concrete Linings in Tunnels and Shafts".

A variant of an extruded tunnel lining system is the tunnel drive shield system, as disclosed in U.S. Pat. Nos. 4,265,565 and 4,334,800. This system, which is primarily used for temporary tunnel support, utilizes a hydraulic advance ram to move an elongate member in a longitudinal direction relative to a support frame.

Various other techniques have been devised for decreasing the labor and expense associated with forming shaft linings. U.S. Pat. No. 4,222,681 discloses a tunnel shield machine utilizing a device for absorbing the thrust force from a drive mechanism and transmitting that force to the concrete tunnel, while another version of a tunnel shield machine is disclosed in U.S. Pat. No. 4,332,508. U.S. Pat. No. 4,437,788 discloses techniques for forming a continuous concrete wall in tunnels or galleries, and a drive shield machine including a plurality of cutters is disclosed in U.S. Pat. No. 4,482,270. U.S. Pat. No. 4,316,701 discloses techniques for stripping off suitably interconnected vault segments of a liner, and U.S. Pat. No. 4,451,176 discloses a tunnel lining produced by spraying concrete rearwardly between the spaces of a multipart framework. None of these techniques have, however, been widely accepted because of increased costs, high labor, and relatively slow progress rate for such tunnel lining techniques.

The disadvantages of the prior art are overcome by the present invention, and improved methods and apparatus are hereinafter described for forming concerte liner in a tunnel or shaft.

SUMMARY OF THE INVENTION

The concrete lining machine of the present invention includes three sections, each section being different in cross-section, but similarly having longitudinal and circumferential frame members and supporting plates. But main and/or auxiliary plates in each section move relative to their respective frames, and provide support for the earth or the uncured concrete without resulting in the high friction associated with slip form machines as the device moves through the tunnel. Accordingly, the machine of the present invention can be provided directly behind and does not significantly limit the speed of the tunnel boring machine, and requires a relatively small propulsion force to move the machine through the tunnel.

The first section of the machine includes circumferentially spaced main plates which provide partial support for the newly excavated ground. The first section also typically houses the propulsion force for the entire machine. The second section is designed to seal the fresh concrete pumped between the main and auxiliary plates of this section and the walls of the tunnel. The main and auxiliary plates are placed alternately in an adjoining arrangement that seals the sides of the plates and allows the machine to move continuously to provide full face support for the fresh concrete. Each sealing plate remains substantially in a fixed position relative to the walls of the tunnel until the plate reaches the end of its section, at which time the plate is returned to the beginning of the second section. The third or last section of the machine includes main plates from the second section to support the hardening concrete which may not yet have sufficient strength to be self supporting.

A significant advantage of the present invention compared to prior art concrete lining machines, particularly those of the slip or jump form, is the elimination of high frictional resistance during movement of the lining machine through the tunnel. In slip or jump form concrete lining machines, this high friction frequently induces cracks in the extruded concrete lining, thereby substantially obviating the benefit of the lining. Moreover, such high friction frequently causes high wear of concrete lining machine components, and restricts the permissible advancing speed of the machine. Thirdly, this high friction requires a very large and expensive propulsion force to move the concrete lining machine through the tunnel. These friction-related problems are avoided by the present invention which enables the support plates to rotate relative to the frame of the machine.

A further feature and advantage of the present invention relates to the simplicity of the machine. Neither the machine nor its parts are complex, so that there is little possibility of a machine breakdown. Even if the concrete boring machine should stop moving for some reason, the concrete lining machine of the present invention may temporarily cease movement without the detrimental results commonly associated with slip form machines. Also, the additional force required to move the machine after shut down is nominal, since this force is merely the force required to detach the plates from the cured concrete. Because of its design, the total propulsion force required to move the machine is substantially less than "slip form" machines.

As a further feature of the present invention, the machine components are easily transported to a desirable location and assembled within the tunnel. The standard machine components enable the length of the machine and the advancing speed of the machine to be easily adjusted to suit the particular needs of the site. Various portions of the machine, and more particularly the first portion, may be altered depending on the ground conditions, thereby increasing the flexibility of the machine for various uses.

An additional feature of the invention relates to the utilization of connecting and disconnecting mechanisms to transfer plates from a rear roller for a chain of plates to the front roller for that chain at a rate substantially faster than the movement of plates from the front to the rear roller. This feature of Applicant's invention reduces costs since less plates are required, and also reduces the weight of the machine and thus the strength of the machine frame.

The methods and apparatus of the present invention thus enable the machine to be effectively used as a continuous shaft lining technique behind a tunnel boring machine. The advancing speed of the machine can be increased to that of any tunnel boring machine or other material transport system, so that the concrete lining machine is not the limiting factor in the permissible tunneling speed.

These and further features and advantages of the present invention will become apparent from the following detailed description, wherein reference made to the figures in the accompanying drawings.

DETAILED DESCRIPTION OF PREFERRED EMBODIMENTS

Figure 1:
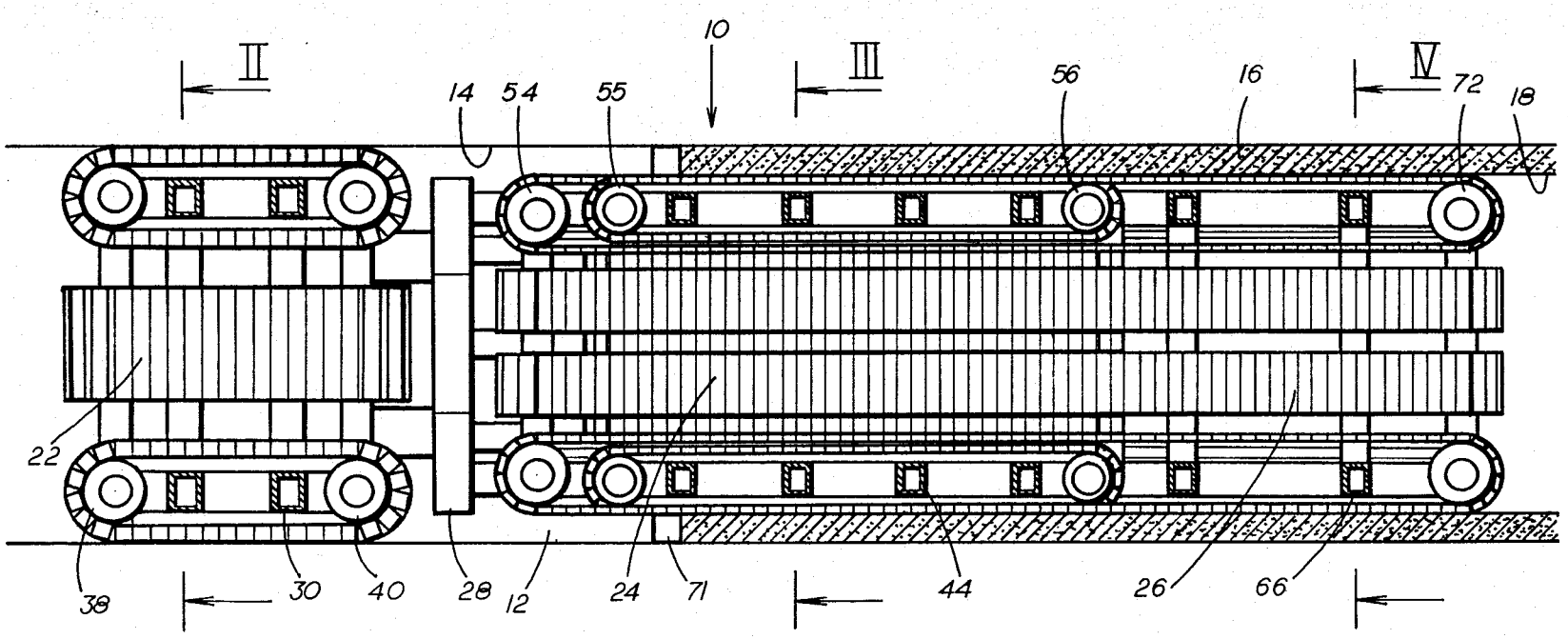
FIG. 1 is an elongated cross-sectional view, taken along an axial plane, of the concrete lining machine according to the present invention.

FIG. 1 depicts a suitable concrete lining machine 10 according to the present invention movable within an excavated tunnel 12 having circular earthen walls 14. The machine of the present invention is suitable for forming a concrete lining 16 about the perimeter of the earthen walls, thereby sealing the tunnel and providing the necessary structural support for safety. The concrete lining 16 is thus formed in the annulus between the excavated earthen walls 14 and the circular outer portion of the machine 10, thereby forming the inner circular concrete walls 18 which define the lined tunnel 20.

It should be understood that machine 10 of the present invention may be suitably positioned directly behind a conventional tunnel boring machine. Temporary lining supports are not required, thereby substantially reducing both labor costs while increasing construction speed and safety. Moreover, the machine 10 of the present invention is capable of progressing at rates equal to or in excess of the tunnel boring machine, i.e., in excess of 30 feet per hour and preferably at rates of approximately 60 feet per hour or more. Thus, the tunnel lining machine does not limit the effective speed of tunnel construction operations, and the tunnel boring machine and tunnel lining machine can move substantially as a unit through the earth jointly forming and lining the tunnel.

Machine 10 shown in FIG. 1 comprises a front portion 22 for partially supporting the earthen tunnel walls between the tunnel boring and tunnel lining operations, an intermediate portion 24 for providing a temporary sealed interior surface for the fresh concrete pumped in the annulus for forming the concrete lining, and a rearward portion 26 for partially supporting the semi-cured concrete which may not yet be sufficiently hardened to be self-supporting when passing by the intermediate portion. A suitable mechanism 28 is provided for mechanically interconnecting the intermediate and rearward portions to the front portion which, as explained subsequently, houses the driving mechanism for the machine 10.

Figure 2:
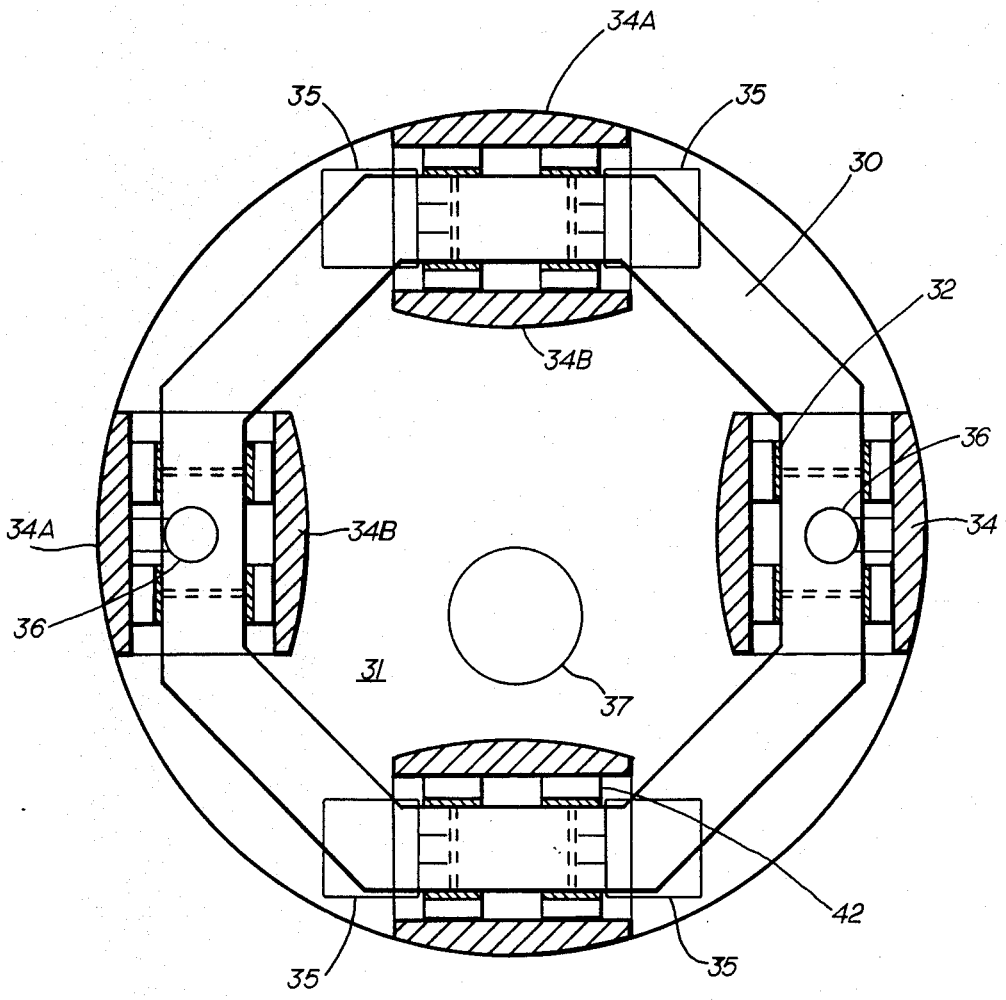
FIG. 2 is a cross-sectional view, taken along a radial plane, of the front support portion of the machine depicted in FIG. 1, including main plates.

Each of the machine portions 22, 24 and 26 include both circular and longitudinal frame members. Referring to FIGS. 1 and 2 and the front portion of the machine, circular frame 30 may be formed, for example, in a circular or octagonal configuration from rectangular structural members. Pairs of I-beams 32 provided along alternate portions of the octagonal circumferential frame may form the longitudinal structural supports for plates 34. As shown in FIGS. 1 and 2, the plates 34 are provided in four continuous chains, each chain of plates rotating about conventional chain rollers 38 and 40 rotatably mounted to the structural frame. The outer plates 34A thus provide partial support for the earth until the concrete lining is formed, and the inner plates 34B are returned to complete the circuitous path of the plates. The plates 34 are supported by suitable roller units 42 spaced between the plates and I-beams 32 and are shown mounted at 90° spaced circumferential intervals along the similarly spaced longitudinal supports. The roller units 42 generally shown in FIG. 2 are mounted to the plates, and are functionally similar to the lighter-weight roller units shown in FIG. 6 and described subsequently with respect to the intermediate machine portion. The top and bottom roller units are representatively shown in FIG. 2 as being driven by electric motors 35, which rotate the chain roller 38 and 40. The side roller units are representatively shown as being driven by hydraulic rams 36, each having one end affixed to the frame 30 and the other end having a pushing device (not shown for engaging the plates. Substantially less driving force is required than for slip form tunnel lining machines because of the reduced frictional force of the machine according to the present invention.

It should be apparent that the plates 34 do not provide full support for the earthen walls of the tunnel, since partial support will be sufficient to maintain the earthen walls in place until the concrete liner can be formed. Although four longitudinal support chains are provided in FIGS. 1 and 2 spaced at 90° intervals, it should be apparent that more or less support chains may be provided for the front portion 22, depending upon the anticipated consolidation of the tunneled earth.

Within the interior 31 of the circumferential frame 30, a suitable concrete pumping machine 36 is provided for supplying a concrete mixture to the annulus between the earthen walls and the plates. Also, the interior 31 of the front portion, as well as the interior of the intermediate and rearward portions, includes a suitable material conveying device 37 or pipe lines for transmitting tunneled earth (muck) from the boring machine through the tunnel lining machine and thence to the surface, and for transporting concrete from the surface to the machine. Such conveying devices are conventional and thus are only generally depicted in FIG. 2.

Figure 3:
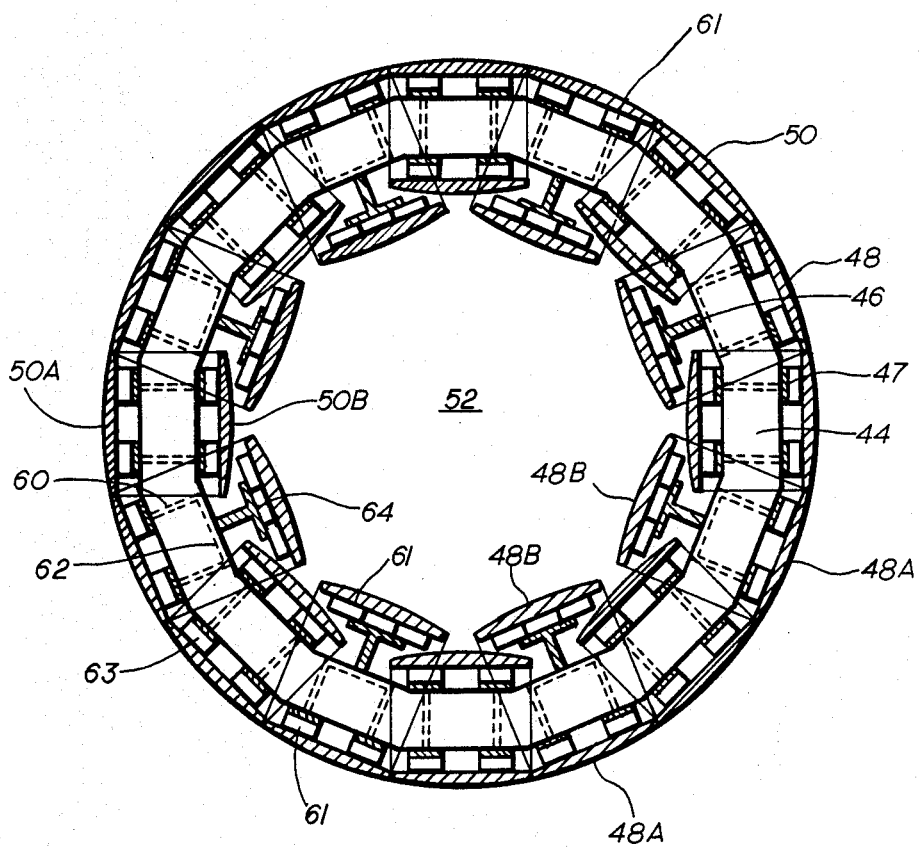
FIG. 3 is a cross-sectional view, taken along a radial plane, of the center support portion of the machine shown in FIG. 1, including main and auxiliary plates.
Figure 4:
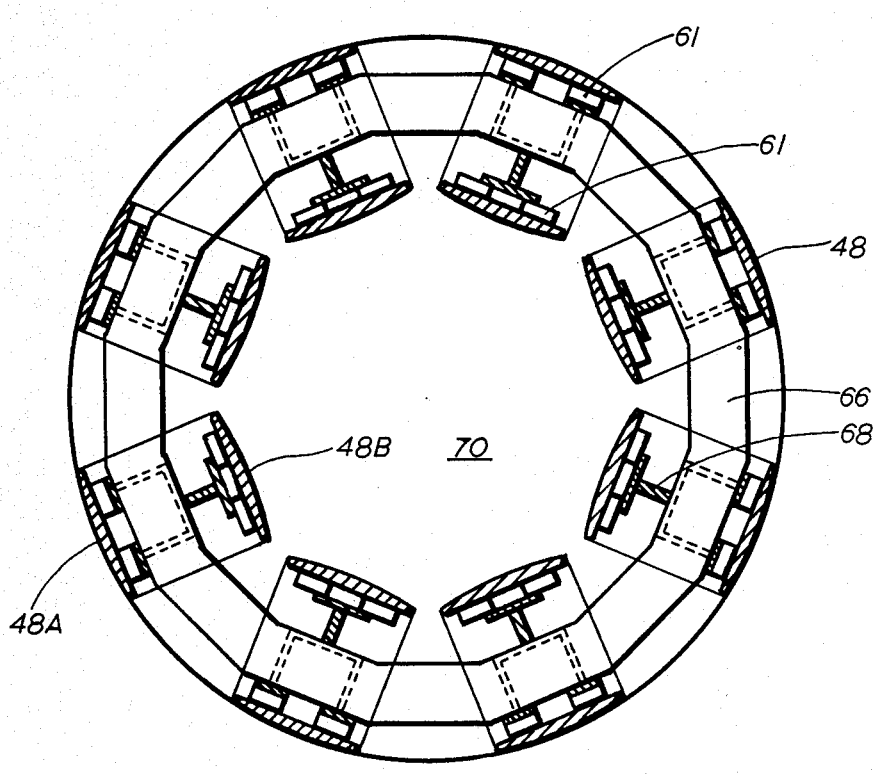
FIG. 4 is a cross-sectional view, taken along a radial plane, of a rear support portion of the machine shown in FIG. 1, including main plates.

Referring to FIGS. 1 and 3, the intermediate portion 24 includes a plurality of longitudinally spaced circumferential frame members 44, which may be formed from structural rectangular tubing welded in a generally circular configuration. The longitudinal structural members comprise, alternatively, pairs of I-beams 47 (similar to the I-beams of the front portion) which support the auxiliary plates 50, and an elongate member 46 for supporting the main plates 48. These longitudinal and circumferential members of the intermediate machine portion thus form a generally cylindrical frame having an interior 52 for receiving the material transport device 37 (not depicted).

Each main plate 48 is provided in one of a plurality of adjoining chains each of which rotates about conventional roller or gear 54 at the front end of the intermediate machine portion, and a corresponding rear roller or gear 72 provided within the rearward portion of the machine. Gears 54 and 72 may also be driven by suitable electric motors (not shown in FIGS. 1 or 3) and give propulsion force to the machine. The auxiliary plates 50 similarly rotate in one of a plurality of chains about rollers 55 and 56 each provided in the intermediate portion of the machine. The designation 48A is used for denoting plates which are positioned along the exterior of the machine to form the sealing surface for the concrete, while plates 48B are being returned to the front roller 54 to complete the chain. Similarly auxiliary plates 50A are positioned along the exterior of the machine at the same radially outward position as main plates 48A, while plates 50B are being returned to the roller 55.

Each of the elongate longitudinal members 46 comprises a pair of T-beams 60 joined at their base by plate 62 to form a substantially U-shaped cross-sectional configuration, with a second H-beam 64 method or device suitably joined along the central portion of plate 62 as shown. Radially outward roller unit 61 are affixed to the plates 48A for supporting the main plates while positioned radially outwardly from the T-beams 60, and the same roller units 61 thus provide support between the main plates and the radially inward portion of T-beam 64 for guiding the main plates which being returned to the chain roller 54. Similarly, roller units 63 are secured to the auxiliary plates 50 and provide sealing support along the inner and outer surfaces of the I-beams 47 in a manner similar to the roller units shown in FIG. 2.

The rearward portion 26 of the machine similarly comprises a circumferential frame member 66 suitably formed from rectangular structural tubing, and a plurality of longitudinal frame members 68 structurally identical to, and preferably merely a structural extension of, members 46. Thus, the main plates 48 in the intermediate machine portion pass through the rearward portion and about the rear chain roller 72, and are guided along the longitudinal frame members by previously referenced roller units 61. The interior 70 of the rearward portion 26 thus houses the material handling unit 37 shown in FIG. 2, which also contains sufficient space for additional equipment, such as back-up pumps.

Referring again to FIG. 3, it should be apparent that the side edges of the main and auxiliary plates 48, 50 abut or are in engagement to form a continuous substantially circular sealing surface for the concrete, and thus form an efficient tubular sealing surface between chain rollers 55 and 56. The combination of the main and auxiliary plates thus provides the interior surface for concrete pumped from a suitable source (not shown) generally outside the tunnel and injected in the annulus slightly downstream from the curb ring 71. As the machine 10 progresses in the tunnel, the concrete cures so that, by the time the main and auxiliary plates are separated at the location adjacent chain roller 56, the semi-cured concrete is partially self-supporting. In order to provide sufficient support to minimize collapse of the newly formed concrete, the main plates 48 continue providing partial support for the newly formed concrete lining along the rearward portion 26 of the machine. By the time the concrete reaches the chain roller 72, the concrete is sufficiently self-supporting so that no further supplemental support is not required. A significant benefit of utilizing the rearward portion 26, rather than merely extending the intermediate portion 24, is that the weight and cost of the machine 10 will be minimized by increasing the spacing between frames. Lighter frame members and the absence of auxiliary plates in the rearward portion may also be used to reduce both the weight and cost of the rearward portion compared to the intermediate portion.

The concrete mixture used to form the lining 16 will, of course, partially be of the quick-setting variety generally used with prior art slip form concrete lining machines. As explained further below, the length of both the intermediate and rearward portions 24, 26 may be easily adjusted depending upon the anticipated speed of the machine, the properties of the concrete utilized, and the anticipated weight of the earth on the newly formed concrete lining. Thus the four circumferential frame members 44 in the intermediate section of the machine, and the two circumferential frame members 66 in the rearward portion of the machine, are merely illustrative of a suitable embodiment, and more or less circumferential supports may be utilized depending upon the desired length of these machine portions. The curb ring 71 may be similar to the curb ring utilized in the continuous shaft lining system previously discussed, although slight modifications may be necessary since sliding occurs along both the exterior and interior surfaces of the curb ring, while sliding only occurring along the exterior portion of the curb ring when used in the apparatus of the continuous shaft lining system.

Figure 5:
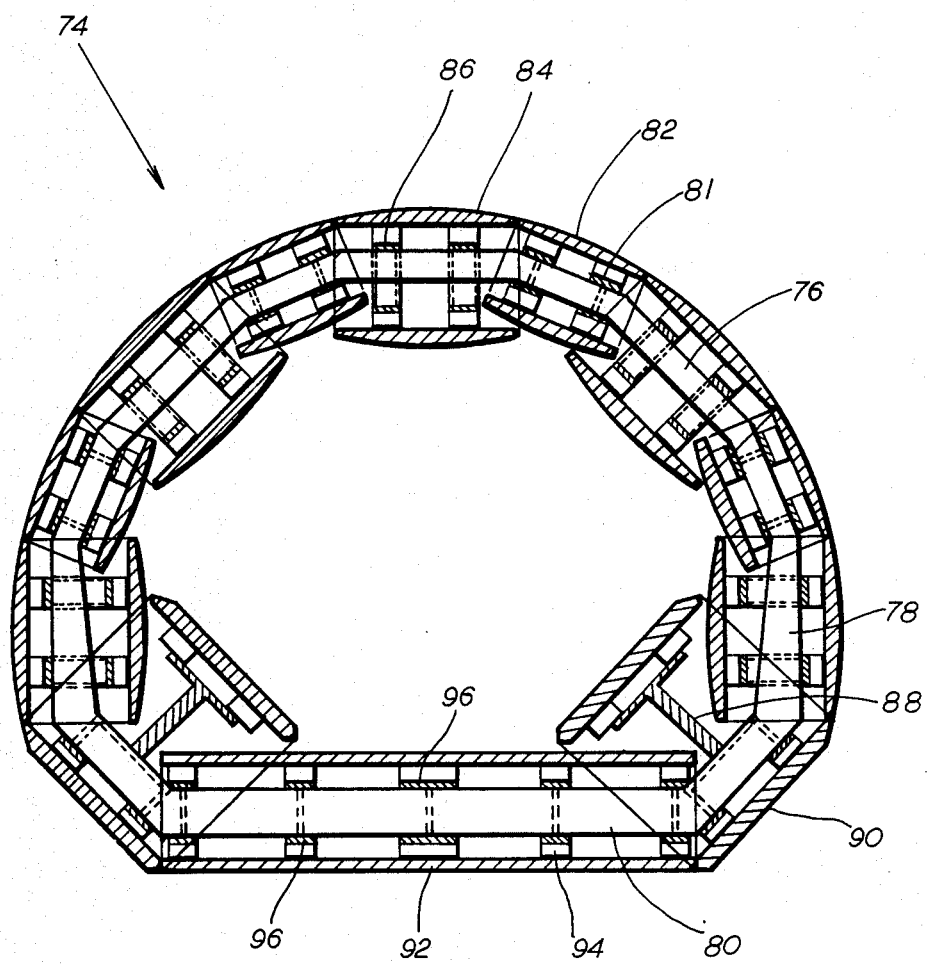
FIG. 5 is a cross-sectional view of an alternative embodiment of the apparatus depicted in FIG. 3.

FIG. 5 depicts an alternate embodiment of the apparatus shown in FIG. 3 and suitably illustrates that the machine of the present invention may be modified to form a non-circular tunnel liner. The substantially horseshoe-shaped machine 74 shown in FIG. 5 thus comprises a circular circumferential frame 76 with an upper portion similar to the upper portion of the circumferential frame shown in FIG. 3, and having reinforced lower side portion 78 and a base portion 80 each comprised of structurally enhanced rectangular tubing. Longitudinal members 81 and auxiliary plates 82 are similar to the components shown in FIG. 3, although the main plates 84 are supported on longitudinal members of an alternate design, with the longitudinal members comprising a pair of rectangular structural members 86 affixed to the circumferential frame 76. As in the embodiment shown in FIG. 3, the longitudinal members and the roller units position one set of plates, e.g., the main plates, radially inward compared to the other set of plates as the plates are returned to the front end of the intermediate portion of the machine.

Special longitudinal members 88, each structurally similar to the members 46 shown in FIG. 3, are provided for supporting special plates 90 provided between the main plates 84 and base plates 92. Base plates 92, as shown, are supported by a plurality of roller units 94, each mounted to the base plate 92, which form part of the longitudinal frame, for engagement with the I-beams 96.

The remaining components of the tunnel lining machine shown in FIG. 5 should thus be apparent from the earlier description and the above description of the horseshoe-shaped intermediate portion. FIG. 5 thus illustrates that the machine of the present invention can be easily modified to form a lining in a tunnel of almost any practical configuration.

Figure 9:
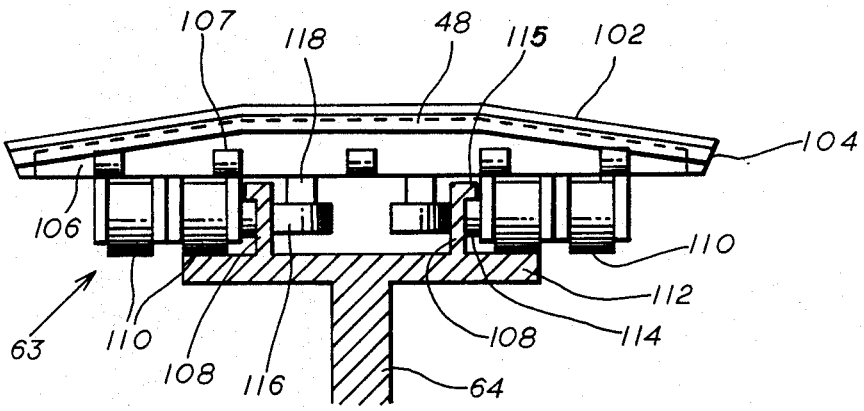
FIG. 9 is a cross-sectional view of a portion of a suitable main plate according to the present invention.

FIG. 9 depicts in greater detail a suitable main plate and pair of roller units 63 for rolling engagement with the T-beam 64 shown on FIG. 3. Each main plate 48 comprises a slightly curved exterior surface 102 for engagement with the concrete, tapered and end surfaces 104 (discussed subsequently), and a substantially planar side surfaces 106. The front and rear edge surfaces of the main plate are suitably provided with a plurality of plate connectors 107 (discussed subsequently).

Figure 6:
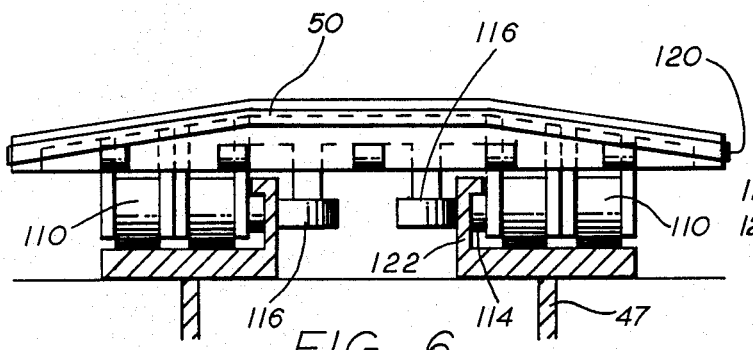
FIG. 6 is a cross-sectional view of a portion of a suitable auxiliary plate according to the present invention.

A pair of radially inwardly extending legs 108 welded to or formed as part of the T-beam 64 are provided as shown, and similar radially outwardly extending legs may be provided at the ends of T-beams 60. The main rollers 110 are secured to a shaft (not shown) rotatably mounted on planar supports 123, each affixed to an exterior surface 102. The main rollers 110 thus provide rolling support between the T-beams 64 (and the T-beams) and the main plate. Each of the four main rollers 110 of each roller unit thus engage a rolling surface on the T-beam 60 to provide support for the concrete, although only two of the main rollers engage the T-beam 64 since the main plate as shown in FIG. 6 is not in engagement with the concrete, but rather is in its substantially uncompressed state while returning to the chain roller 54. Also, a tension roller 114 is rotatably mounted on the same shaft or another shaft extending from support 123 for rolling engagement with lip 114 of leg 108, thereby preventing the main plate from substantially disengaging from the T-beam 64. Finally, a pair of lateral rollers 116 each rotatably mounted on shaft 118 affixed to the main plate 50 are provided for engagement with the inner side walls of legs 108, providing the desired lateral support for the main plate.

Although not depicted, it should thus be understood that similar main, tension, and lateral rollers may be provided for forming the roller unit 61 as shown in FIG. 3 adjacent the end of T-beam 60. The primary purpose of these rollers is to reduce the frictional forces of the plates moving with respect to the frame. Accordingly, the main rollers will preferably be sized to handle the sizable weight of the machine 10 on the concrete, and/or the weight of the concrete and concrete pumping pressure on machine 10, while the tension rollers provide a pulling force to the main plate and the lateral rollers prevent the plates from disengaging from the longitudinal frame members and keep the plates aligned with the longitudinal frame members during movement.

FIG. 6 depicts an auxiliary plate 50 in greater detail adjacent the longitudinal I-beam 47 shown in FIG. 3. The auxiliary plate 50 is similar to the main plate 48, with the primary difference relating to the configuration of its side edges 120. A leg 122 is affixed to each of the T-beams 47, and main, tension, and lateral rollers are provided for engagement with the T-beam or the leg 122, as previously described. FIG. 6 further depicts that various configurations of longitudinal members may be utilized for supporting the plates according to the present invention.

Figure 7:
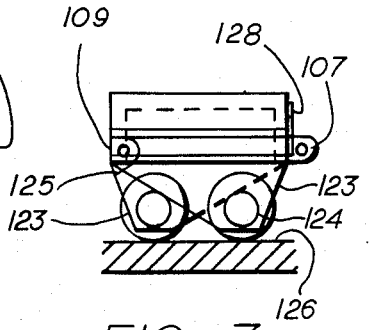
FIG. 7 is an end view of the auxiliary plate shown in FIG. 6.

FIG. 7 clearly depicts rollers 110 mounted on shafts 124 rotatably affixed to planar supports 123, which in turn are affixed to the curved plate of the auxiliary plate. Rollers 110 engage the outer surface 126 of T-beam 47, and provide the primary support for the main and auxiliary plates.

Figure 8:
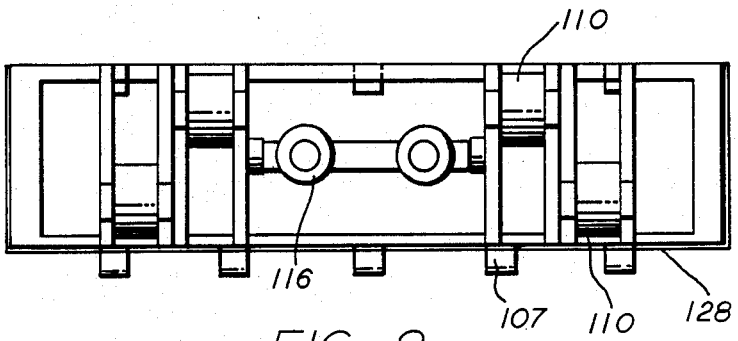
FIG. 8 is a bottom view of the auxiliary plate shown in FIG. 6.

FIGS. 6, 7 and 8 together illustrate the suitable plate connectors 107 utilized with both the main and auxiliary plates of the present invention. These plate connectors 107 pivotally interconnect adjoining front and rear edges of the main and auxiliary plates in a conventional hinged manner to form the "chains" of plates, with the projecting connection 107 of one plate fitting within a suitable receptacle 109 of the adjoining plate. Surface 125 is cut at an angle at, e.g., 30° to enable the main plate to rotate relative to the auxiliary plate when two adjoining plates reach the gears 54, 55, 56 or 72. The front of each plate, as well as the sides of the plates, may be provided with a suitable elastomeric material, such as a rubber packing 128, for increasing the sealing effectiveness between the plates in one chain, plates, and between the plates of one chain and the plates of the adjoining chain thereby decreasing the likelihood of concrete leakage between the plates and into the interior 52 of the intermediate portion.

Figure 10:
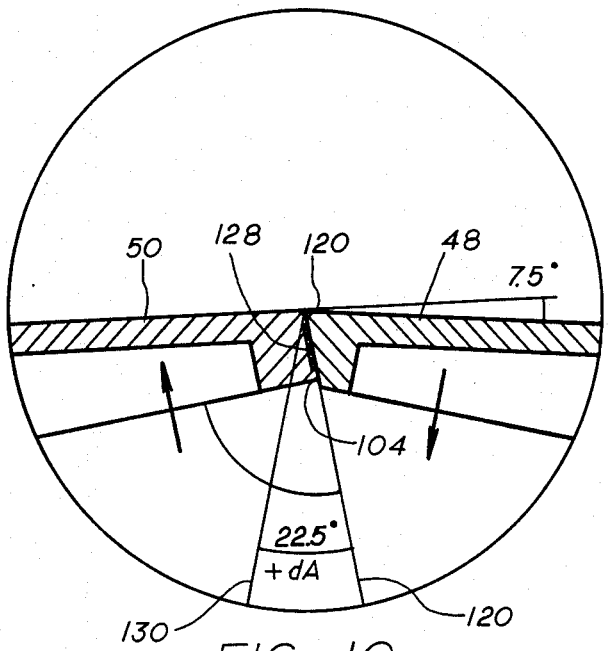
FIG. 10 is a cross-sectional view of a suitable ceiling mechanism between the main and auxiliary plates.

FIG. 10 depicts the side edge of a main plate in sealing engagement with the side edge of an auxiliary plate. The edge 104 of the main plate is inclined radially inwardly at an angle of, for example, 22.5° (plus a differential angle), with the sides and the 22.5° angle representing respective lines perpendicular to the main and auxiliary plates, respectively, as shown in FIG. 3. The edge 120 of the auxiliary plate is angled outwardly from line 130 by this same 22.5° + differential angle, with the differential angle being from 1° to 5°. This differential angle is provided for facilitating removal of the auxiliary plate from the main plate at, e.g., gear 56. To keep the edges of the main and auxiliary plates in contact, the main plates may be biased inwardly and the auxiliary plates biased outwardly, thereby enhancing the sealing effectiveness of the rubber packing 128 provided between the plates. This biasing force on each of the plates may usably be provided while the plates are positioned to turn the cylindrical shaped outer sealing surface between chain rollers 55 and 56 by providing a slight alteration of the dimensions between the roller units and the plates, so that the longitudinal frame members in conjunction with the roller units bias the plate sides inwardly or outwardly. The inclined edges of the main and auxiliary plates as shown on FIG. 10 further enables the auxiliary plates to be easily separated from the main plates at the position adjacent roller 56, and further facilities proper placement of the main plates and the auxiliary plates at the position adjacent roller 55.

Figure 11:
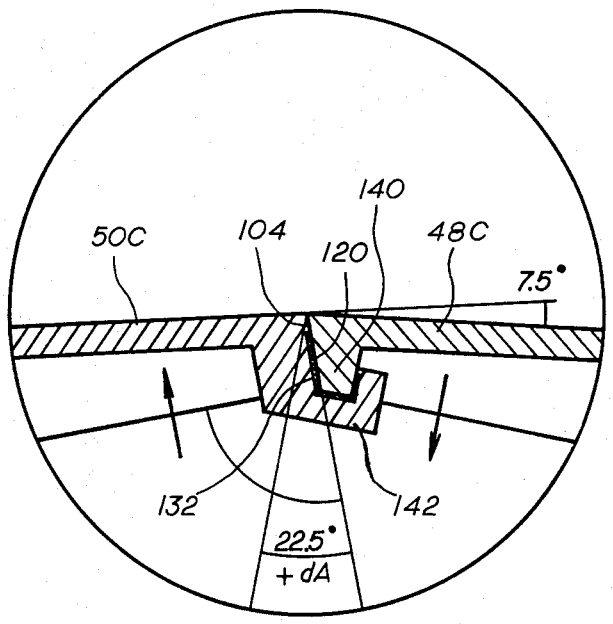
FIG. 11 is a cross-sectional view of an alternate embodiment of the ceiling mechanism shown in FIG. 10.

FIG. 11 depicts an alternate embodiment of a sealing mechanism between main and auxiliary plates. The edge of main plate 48C are provided with a radially inwardly projecting lip 140, while the edges of the auxiliary plate 50C are provided with a similar radially inwardly projecting lip 142 which forms a groove for receiving lip 140. Lips 140 and 142 can thus be interlocked, so that the rubber packing 132 provided between the engaging surfaces of these lips will seal the interior of the intermediate portion 24 from the concrete. Also, the surfaces 104 and 120 of the embodiment shown in FIG. 11 are preferably inclined, and these main and auxiliary plates are also biased for increasing sealing effectiveness, as previously described. Should leakage of concrete occurs in the intermediate portion between the main and auxiliary plates when positioned to form the cylindrical-shaped sealing surface, the concrete mixture may be stiffened, or the concrete pumping pressure reduced.

Figure 12:
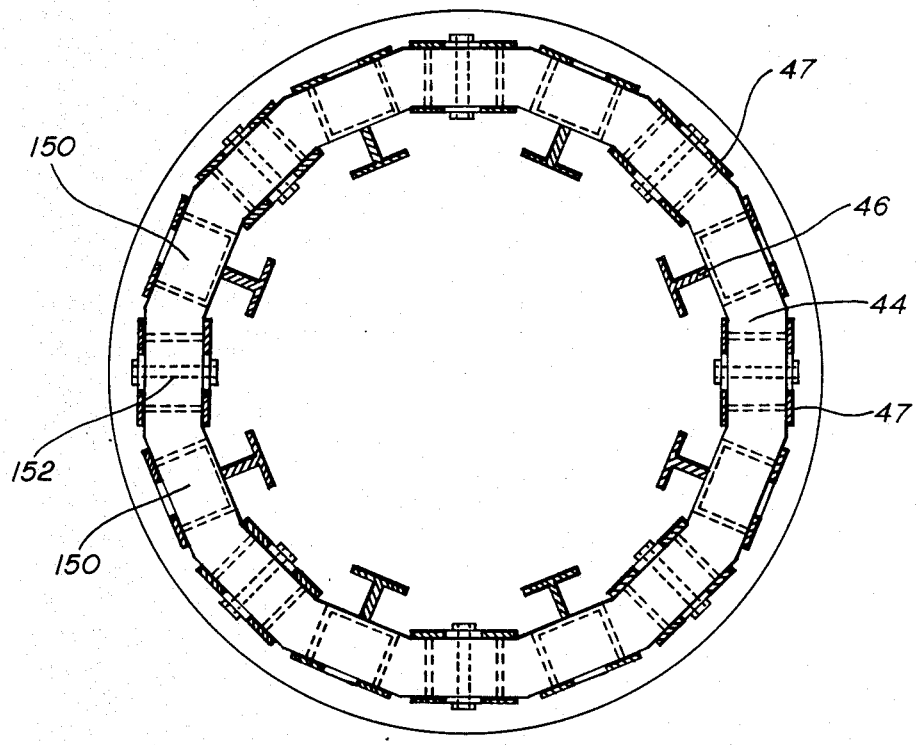
FIG. 12 is a simplified cross-sectional view, taken along a radial plane, of the frame depicted in FIG. 3.
Figure 13:
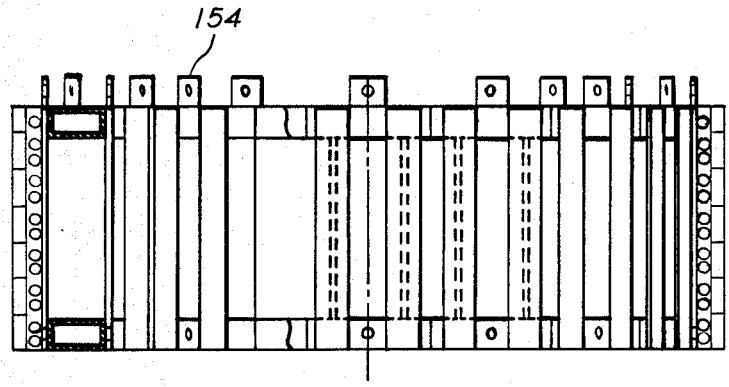
FIG. 13 is an end view of the frame depicted in FIG. 12.

FIG. 12 depicts a simplified cross-sectional view of the circumferential frame illustrated in FIG. 3. The circumferential frame in FIG. 12 comprises longitudinal I-beams 47 and longitudinal T-beams 46 previously described, although each of these beams are composed of a longitudinally spaced sections 150 interconnected by connecting pins 152. As shown in FIG. 13, a plurality of connecting tabs 154 each secured to a circumferential frame allow for the length of the longitudinal beams 46, 47 to be easily modified by adding or deleting another section of the longitudinal frame. Thus, it should be understood that the frame for the intermediate portion 24 shown in FIG. 1 may suitably comprise four identical sections 150 of longitudinal frame with each section being joined by the extension tabs 154 and the pins 152 as shown in FIGS. 12 and 13. Similarly, the circumferential frames may, if desired, be composed of arcuate-shaped members which may be similarly joined together at the site to form, e.g., an octagonal-shaped frame. FIGS. 12 and 13 thus illustrate that the machine of the present invention may be assembled at the jobsite and then disassembled and moved to another site. Moreover, the three portions of the machine may easily be altered in length to accomodate the ground conditions and designed tunnel boring speed.

In one embodiment of the invention, a plate connecting and disconnecting mechanism is provided for enabling each plate to move relatively quickly from a position adjacent a rear roller for a plate chain to a position adjacent the front roller for that chain. This feature of applicant's invention enables applicant's apparatus to achieve the benefits of a continuous chain, while reducing the required number of plates and thus the cost and weight of the plates. The reduction in plate weight, in turn, allows the frame of the machine to be fabricated from lighter weight and/or further spaced components, thereby further reducing machine costs.

Figure 18:
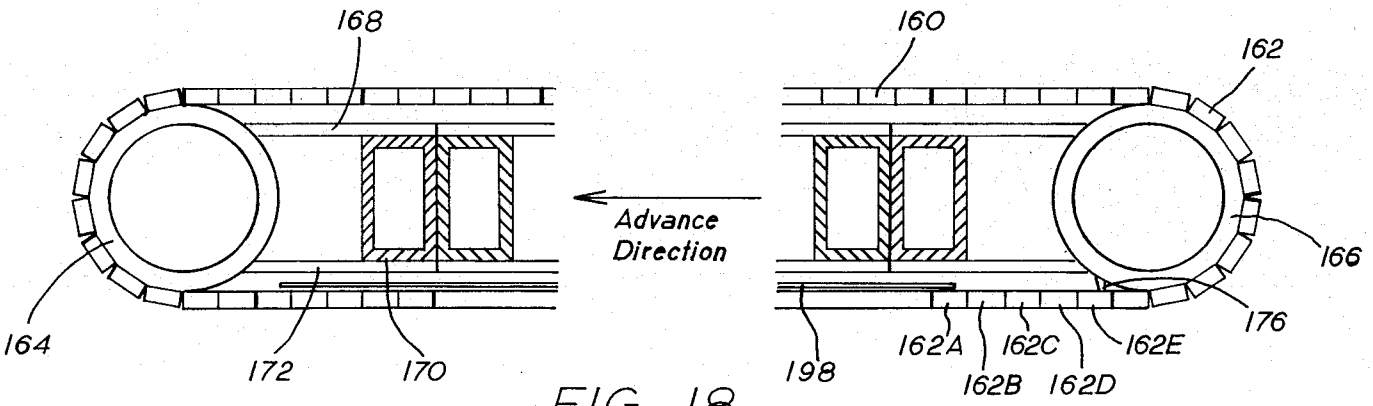
FIG. 18 is a simplified schematic diagram of a suitable plate chain with the connecting and disconnecting mechanism of the present invention.

Referring first to FIG. 18, a continuous auxiliary plate chain 160 is composed of a plurality of auxiliary plates 162, and is rotatable about front chain roller 164 and rear chain roller 166, each rotatably mounted about frame 168 comprising a plurality of radial supports 170 and a plurality of longitudinal supports 172, as previously explained. According to the present invention, the connecting and disconnecting mechanism enables a plurality of connected plates 162A, 162B, 162C, 162D, and 162E to move as a unit from a point immediately subsequent to their passing around the rear roller 166 to a position immediately prior to passing around the front roller 164. Since the unit 162A-E moves from the rear to the front roller at a high speed compared to movement of each plate from the front to the rear roller, a continuous chain is effectively formed from plates which together total only slightly more than one-half of the effective chain length, thereby reducing costs and weight.

Figure 14:
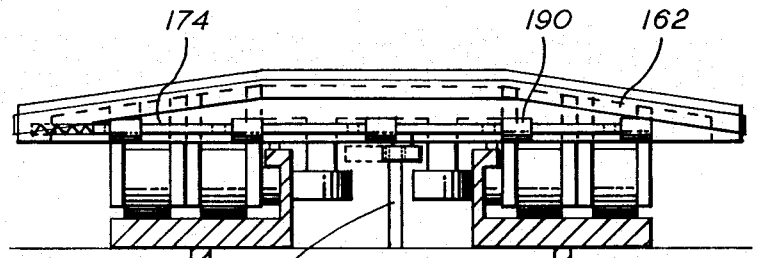
FIG. 14 is an end view of a suitable auxiliary plate having a connecting and disconnecting mechanism.

Referring now to FIG. 14, the auxiliary plate 162 is generally of the type shown in FIG. 6. The auxiliary plates 162 may, however, be modified to include the connecting bar 174 shown in the connected position. A disconnecting bar 176 affixed to the frame 168 is also shown in FIG. 14.

Figure 16:
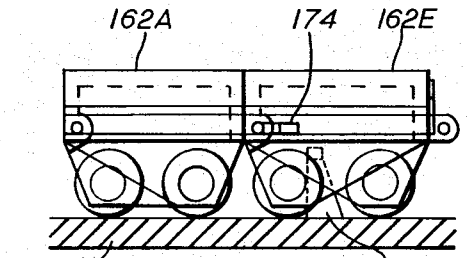
FIG. 16 is a side view of the plates shown in FIG. 15.
Figure 15:
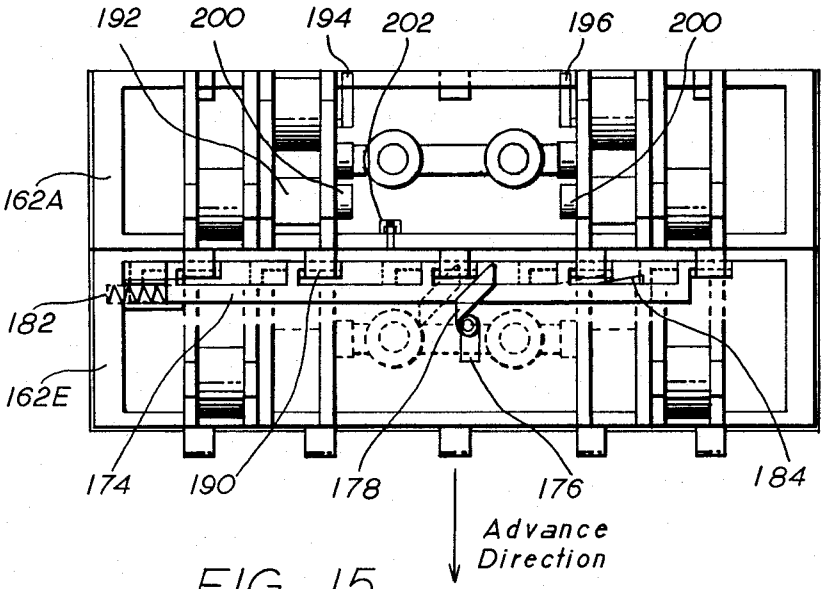
FIG. 15 is a bottom view of two auxiliary plates of the type shown in FIG. 14.

FIG. 15 illustrates two auxiliary plates 162, which may be understood as being end plate 162E of one "unit" and front plate 162A of an adjoining "unit". The connecting bar will normally hold the plates 162E and 162A in connected relationship due to the biasing force of spring 182. An end view of plates 162E and 162A is shown in FIG. 16, which also generally depicts a connecting bar 174 and the disconnecting bar 176 affixed to the machine frame 168.

As the plates advance in the direction shown in FIG. 15, a connecting bar knob 178 will engage the fixed disconnecting bar 176, thereby compressing spring 182 and causing the connector bar to move to the position shown in dash lines in FIG. 15, thereby allowing the units to separate. An automatic lock unit 184 (FIGS. 15 and 17) carried by the connecting bar 174 and including a ramp surface 186 biased upwardly by spring 188 engages the connectors 190 and prevent the connecting bar from returning to the locked position.

Figure 17:
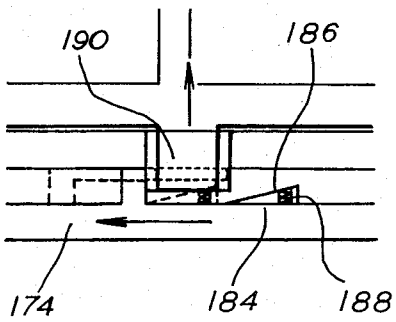
FIG. 17 is a schematic diagram of the automatic locking unit for controlling the connecting and disconnecting bars shown in FIG. 15.

When connecting bar 174 is in the dotted position, plates 162A and 162E will be separated. When the connector 190 shown in FIG. 17 is moved out, then the automatic lock unit 184 will be in dotted position. Even though connecting bar 174 thus is pushed by the spring 182, the automatic lock unit 184 will prevent connecting bar 174 from returning to connected position.

Each unit of plates will have a desired propulsion device, such as an electric motor 192 shown in FIG. 15. Once a plate unit 162A–E becomes disconnected from an adjoining plate unit by passing the disconnect bar 176 (FIG. 18), electric contacts 194, 196 engage power line 198, thereby energizing motor 192 to rotate drive wheels 200, causing the unit to quickly move to a position immediately adjacent the front roller 164. Once a unit of plates arrives at a position shown in FIG. 18 adjacent and below roller 164, a front plate 162A will engage a rear plate 162E of a relatively stationary unit, causing the connector 190 to compress the automatic lock units 184, thereby allowing the connecting bar 174 to return to the connecting position in response to spring 182 and lock the units together again.

Figure 20:
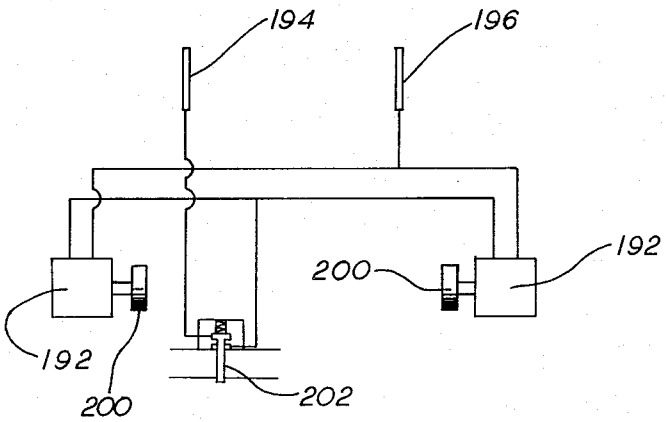
FIG. 20 is a simplified schematic diagram of an electrical power system for driving a plate chain according to the present invention.
Figure 19:
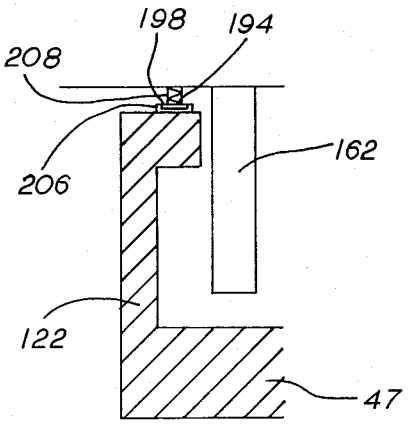
FIG. 19 is a simplified schematic diagram of the electrical power connection for the unit shown in FIG. 18.

Once the plate units are connected, switch 202 disconnects power from the powerline 198 to the drive motor 192, so that operation of the drive motor is terminated even if the contacts 194, 196 continue to engage the powerline 198. Referring to FIG. 19, electric powerline 198 and a suitable lead 194 are insulated from the leg 122 affixed to the T-beam 47 by a suitable insulator 206. FIG. 19 also illustrates that lead 194 may be normally biased for engagement with the powerline 198 by spring 208. FIG. 20 shows a suitable electric circuit for driving a plurality of motors 192, with the power to each of the motors being automatically terminated by operation of the switch 202.

The propulsion system for the machine may be located in any or all of the three machine portions: the front portion, the intermediate portion or the rearward portion. Also, hydraulic rams may be used instead of electric motors for propelling the machine through the tunnel, preferably behind a tunnel boring machine. Although the invention has been described in terms of specified embodiments which are set forth in detail, it should be understood that this is by illustration only and that the invention is not necessarily limited thereto, since alternative embodiments and operation techniques will become apparent to those skilled in the art in view of the disclosure. Accordingly, modifications are contemplated which can be made without departing from the spirit of the described invention.

What is claimed and desired to be secured by Letters Patent is:

1. Apparatus positionable behind a tunnel boring machine for forming a concrete lining in a tunnel by injecting a concrete mixture in the annulus between the earthen walls of the tunnel and the apparatus, the apparatus including driving means for moving said apparatus within the tunnel and having a passageway for transmitting earthen material from adjacent the tunnel boring machine through the apparatus, the apparatus further comprising:

a first machine portion having a first portion frame;

a plurality of first endless loop chains each including a plurality of first plates each movably mounted about said first portion frame, each of said first endless loop chains having a portion for lying within a first longitudinal plane adjoining the earthen walls for temporarily supporting the earthen walls of the tunnel;

a second machine portion having a second portion frame;

a plurality of second endless loop chains each including a plurality of second plates each movably mounted about said second portion frame, each of said second endless loop chains having a portion for lying within a second longitudinal plane adjoining the interior surface of the concrete lining;

a plurality of third endless loop chains each including a plurality of third plates each movably mounted about said second frame, each of said third endless loop chains having a portion for lying within the second longitudinal plane adjoining the interior surface of the concrete lining;

said second and third plurality of plates being arranged in respective second and third chains alternately spaced about the periphery of the second portion frame and together forming a substantially sealed tubular surface for sealing from said second frame concrete injected in the annulus between the earthen walls and said plurality of second and third plates;

a third machine portion having a third portion frame; and said second plurality of plates each being movably mounted about said third portion frame and arranged in one of said second plurality of endless loop claims for temporarily supporting the concrete lining downstream from the second machine portion as the apparatus moves through the tunnel in response to said driving means.

2. The apparatus as defined in claim 1, where each of the first, second, and third chains rotates about a pair of chain rollers each having an axis substantially perpendicular to a central axis of the apparatus.

3. The apparatus as defined in claim 2, wherein the pair of chain rollers for the second chains are rotatably mounted to the second and third portion frames, respectively, and the chain rollers for the third chains are each spaced between the chain rollers for the second chain.

4. The apparatus as defined in claim 1, where each of the first portion frame, second portion frame, and third portion frame comprises re-connectable members for selectively altering the axial length of the apparatus.

5. The apparatus as defined in claim 4, wherein each of the first, second, and third portion frames comprises:

a plurality of radial supports for forming radial frame portion lying substantially within a radial plane relative to a central axis of the apparatus; and a plurality of longitudinal frame members for forming a longitudinal frame portion lying within a sleeve-shaped configuration axially aligned with the central axis of the apparatus.

6. The apparatus as defined in claim 2, wherein the driving means includes a plurality of electric motors for rotating one or more of the pairs of chain rollers and thus the first, second, or third chains.

7. The apparatus as defined in claim 1, wherein each of the first, second, and third plurality of plates are provided with roller assemblies for rolling engagement between the plates and the respective frame.

8. The apparatus as defined in claim 7, wherein each of the roller assemblies comprises:

a first plurality of main rollers for absorbing primarily radially-directed forces between the plates and the frame; a second plurality of rollers for guiding the path of the plates moving within the first, second, or third chains; and a third plurality of rollers for exerting a radially-directed force on the plates by the frame in cooperation with the roller assembly.

9. The apparatus as defined in claim 1, where each of the second and third chains has a plate return portion spaced interiorly of the second longitudinal plane, and the radial position of the second chain plate return portion is substantially different than the radial position of the third chain plate return portion to prohibit interference between the second and third plurality of chains.

10. The apparatus as defined in claim 9, further comprising:

plate and disconnect means for enabling one or more plates to become disconnected from an adjoining plate and move independently within at least a portion of the plate return portion of its respective chain and for enabling the one or more plates to subsequently become automatically reconnected to another plate.

11. The apparatus as defined in claim 1, wherein each of the first, second and third plurality of plates is pivotably interconnected with another of the first, second and third plurality of plates; and the second portion frame has substantially a circular cross-sectional configuration.

12. The apparatus as defined in claim 1, wherein each of the first, second and third plurality of plates is pivotably interconnected with another of the first, second and third plurality of plates; and the second portion frame has substantially a horseshoe-shaped cross-sectional configuration.

13. The apparatus as defined in claim 1, further comprising:

means for exerting a radially-directed force on the second plurality of plates; and means for exerting an opposing radially-directed force on the third plurality of plates.

14. Apparatus for forming a curable lining in a tunnel by injecting a curable mixture in an annulus between the walls of the tunnel and the apparatus, the apparatus comprising:

a machine frame;

a plurality of main plates each movably mounted about the frame and arranged in one of a plurality of main plate endless loop chains, each of said main plate endless loop chains having a curable mixture support portion for lying within a longitudinal plane adjoining an interior surface of the lining;

a plurality of auxiliary plates each movably mounted about the frame and arranged in one of a plurality of auxiliary plate endless loop chains, each of said auxiliary plate endless loop chains having a curable mixture support portion for lying within the longitudinal plane adjoining the interior surface of the lining; and the plurality of main and auxiliary plates being arranged in respective main and auxiliary chains alternately spaced about the periphery of the frame and together forming a substantially sealed annular surface for sealing from the curable mixture injected in the annulus between the tunnel walls and said plurality of main and auxiliary plates.

15. The apparatus as defined in claim 14, wherein each of the plurality of main and auxiliary chains rotate about a pair of chain rollers each having an axis substantially perpendicular to a central axis of the apparatus.

16. The apparatus as defined in claim 14, wherein each of the main and auxiliary plates are provided with roller assemblies for rolling engagement with the frame.

17. The apparatus as defined in claim 14, further comprising:

means for exerting a radially-directed force on each of the plurality of main plates; and means for exerting an opposite radially-directed force on each of the plurality of auxiliary plates.

18. A method for forming a lining in a tunnel by injecting a curable mixture in an annulus between the walls of the tunnel and a tunnel lining machine, the machine including driving means for moving the machine within the tunnel and having a passageway for transmitting earthen material and mixture through the apparatus, the method comprising:

assembling a machine frame having a plurality of radial frame portions each lying substantially within a radial plane relative to a central axis of the machine, and a plurality of longitudinal frame portions lying within a sleeve-shaped configuration axially aligned with the central axis of the machine;

movably mounting a plurality of main plates about said frame and arranged in one of a plurality of main plate endless loop chains, each of said main plate chains having a curable mixture support portion lying within a longitudinal plane adjoining an interior surface of the lining;

movably mounting a plurality of auxiliary plates about said frame and arranged in one of a plurality of auxiliary endless loop chains, each of the said auxiliary plate chains having a curable mixture support portion lying within the longitudinal plane adjoining the interior surface of the lining;

arranging the plurality of main and auxiliary plates in respective main and auxiliary chains alternately spaced about the periphery of the frame and together forming a substantially sealed annular surface for sealing from the curable mixture injected in the annulus between the earthen walls and the plurality of second and third plates; and extending each of the main plate chains beyond the auxiliary plate chains for temporarily supporting the mixture downstream from the auxiliary plates chains as the machine moves through the tunnel.

19. The method as defined in claim 18, further comprising:

movably mounting a plurality of tunnel support plates about said frame and arranged in one of a plurality of tunnel support endless loop chains, each of said tunnel support endless loop chains having a tunnel support portion lying within a longitudinal plane adjoining the earthen tunnel walls for temporarily supporting the earthen walls of the tunnel.

20. The method as defined in claim 18, further comprising:

exerting a radially-directed force on the main plates and exerting an opposite radially-directed force on the auxiliary plates to increase sealing effectiveness between the main plates and the auxiliary plates.

21. Apparatus for forming a curable lining in a tunnel by injecting a curable mixture in an annulus between the walls of the tunnel and the apparatus, the apparatus comprising:

a machine frame;

a plurality of main plates each movably mounted about the frame and arranged in one of a plurality of main plate endless loop chains, each of said main plate endless loop chains having a curable mixture support portion for lying within a longtidunal plane adjoining an interior surface of the lining and a main plate return portion spaced interiorly of the longitudinal plane;

a plurality of auxiliary plates each movably mounted about the frame and arranged in one of a plurality of auxiliary plate endless loop chains, each of said auxiliary plate endless loop chains having a curable mixture support portion for lying within the longitudinal plane adjoining the interior surface of the lining and an auxiliary plate return portion spaced interiorly of the longitudinal plane;

the plurality of main and auxiliary plates being arranged in respective main and auxiliary chains alternately spaced about the periphery of the frame and together forming a substantially sealed annular surface for sealing from the curable mixture injected in the annulus between the tunnel walls and said plurality of main and auxiliary plates; and plate connect and disconnect means for enabling one or more of the main or auxiliary plates to become disconnected from an adjoining plate in its respective chain and move independently within the respective plate return portion of its respective chain, and for enabling the one or more plates to subsequently become reconnected to another plate in its respective chain.

22. The apparatus as defined in claim 21, wherein each of the plurality of main and auxiliary chains rotate about a pair of chain rollers each having an axis substantially perpendicular to a central axis of the apparatus.

23. The apparatus as defined in claim 21, further comprising:

means for exerting a radially-directed force on each of the plurality of main plates; and means for exerting an opposite radially-directed force on each of the plurality of auxiliary plates.

24. The apparatus as defined in claim 21, further comprising:

driving means movable with the one or more of the main or auxiliary plates to move the plates along the plate return portion of its respective drive.

25. The apparatus as defined in claim 1, wherein the driving means includes a plurality of hydraulic rams for moving one or more of the first, second or third endless loop chains relative to the respective first or second portion frame.

26. The apparatus as defined in claim 14, further comprising:

each of said plurality of main plates including a main plate lip along an edge of each main plate; and each of said plurality of auxiliary plates including an auxiliary plate lip along an edge of each auxiliary plate for interlocking with an adjoining main plate lip.

27. The apparatus as defined in claim 14, further comprising:

each of the main plate and auxiliary plate endless loop chains having a plate return portion spaced interiorly of the longitudinal plane; and plate connect and disconnect means for enabling one or more of the plates to become automatically and temporarily disconnected from an adjoining plate and to move independently of the adjoining plate within at least a portion of the plate return portion of its respective chain and for enabling the one or more plates to subsequently become automatically reconnected to another plate.

28. The apparatus as defined in claim 27, wherein the plate connect and disconnect means comprises:

movable connecting means for temporarily connecting plates;

biasing means for biasing the connecting means in a connected position; and disconnecting means fixed to the machine frame for engaging the movable connecting means and for automatically moving the connecting means to a disconnecting position.

29. The apparatus as defined in claim 27, further comprising:

driving means for powering the main plate and auxiliary plate endless loop chains; and switch means for connecting and disconnecting power to the driving means in response to the connection and disconnection of the plate connect and disconnect means.

30. The method as defined in claim 18, further comprising:

movably mounting a plurality of said tunnel support plates within a plate return portion of a respective endless loop chain spaced interiorly of said tunnel support portion.

31. The method as defined in claim 30, further comprising:

temporarily connecting and disconnecting one or more of said plates from an adjoining plate;

moving said one or more plates independently of the adjoining plate and within at least a portion of the plate return portion of its respective chain; and reconnecting the one or more plates to another plate in the respective endless loop chain.

* * * * *

UNITED STATES PATENT AND TRADEMARK OFFICE

CERTIFICATE OF CORRECTION

PATENT NO. : 4,710,058

DATED : December 1, 1987

INVENTOR(S) : Man Y. Han

It is certified that error appears in the above-identified patent and that said Letters Patent is hereby corrected as shown below:

Column 4, line 58, delete the numeral "20" after --lined tunnel--

Column 5, line 49, change "shown" to --shown)--.

Column 5, line 63, change "36" to --(not shown)--.

Column 8, line 38, after "engage" add --portion 112 of--.

Column 8, line 44, change "114" to --115--.

Column 8, line 48, change "main plate" to --auxiliary plate--.

Column 12, line 37, add "portion" after "second".

Column 13, line 5, add "a" after "forming.

Column 13, line 24, begin the phrase "a second plurality of rollers for guiding the" in a new paragraph.

UNITED STATES PATENT AND TRADEMARK OFFICE

CERTIFICATE OF CORRECTION

PATENT NO. : 4,710,058

DATED : December 1, 1987

INVENTOR(S) : Man Y. Han

It is certified that error appears in the above-identified patent and that said Letters Patent is hereby corrected as shown below:

Column 13, line 39, add "connect" after "plate".

Signed and Sealed this

Nineteenth Day of July, 1988

*Attest:*

DONALD J. QUIGG

*Attesting Officer*

*Commissioner of Patents and Trademarks*